US007971294B1

(12) United States Patent
Murauskos

(10) Patent No.: US 7,971,294 B1
(45) Date of Patent: Jul. 5, 2011

(54) METHOD AND APPARATUS FOR CHANGING A PILLOW OR PILLOWCASE

(76) Inventor: Victor J. Murauskos, New Hyde Park, NY (US)

( * ) Notice: Subject to any disclaimer, the term of this patent is extended or adjusted under 35 U.S.C. 154(b) by 0 days.

(21) Appl. No.: 12/551,770

(22) Filed: Sep. 1, 2009

Related U.S. Application Data

(60) Provisional application No. 61/190,631, filed on Sep. 2, 2008.

(51) Int. Cl.
*A47G 9/10* (2006.01)

(52) U.S. Cl. ..... 5/489

(58) Field of Classification Search ..... 5/489, 482, 5/490–492, 658
See application file for complete search history.

(56) References Cited

U.S. PATENT DOCUMENTS

| | | | | |
|---|---|---|---|---|
| 359,617 | A | 3/1887 | Leonard | |
| 804,456 | A | 11/1905 | Condo | |
| 1,140,583 | A | 5/1915 | Elliott | |
| 1,712,711 | A * | 5/1929 | Morgan et al. | 5/489 |
| 1,743,329 | A | 1/1930 | Dougherty | |
| 4,890,652 | A | 1/1990 | Hoerner | |
| 5,065,965 | A | 11/1991 | Aulabaugh | |
| 5,673,446 | A | 10/1997 | Moen et al. | |
| 6,065,512 | A | 5/2000 | Munn, II | |
| 6,189,841 | B1 | 2/2001 | LaPoint et al. | |
| 6,839,923 | B2 * | 1/2005 | Blessman | 5/489 |
| 7,007,324 | B2 | 3/2006 | Blessman | |
| 7,407,139 | B1 | 8/2008 | Dolan | |
| 2006/0118203 | A1 | 6/2006 | Take et al. | |
| 2006/0185086 | A1 | 8/2006 | Lucas | |
| 2009/0144901 | A1 | 6/2009 | Zorger | |

* cited by examiner

*Primary Examiner* — Fredrick Conley
(74) *Attorney, Agent, or Firm* — Michael A. Adler; Davidoff Malito & Hutcher, LLP

(57) ABSTRACT

Method for changing a pillow in a pillowcase includes providing two members unattached to one another and each having opposed smooth surfaces, inserting the members at least partially into the pillowcase containing a pillow such that the members are each between a respective side of the pillow and an adjacent side of the pillowcase, and then causing relative movement between the pillowcase and the members until the pillow is at least partially outside of the pillowcase. Thereafter, the pillow is grasped and withdrawn from between the members and then without removing the members from the pillowcase, a new pillow is inserted between the members. Then, the individual causes relative movement between the pillowcase and the members until the new pillow is inside of the pillowcase; and withdraws the members from the pillowcase.

9 Claims, 1 Drawing Sheet

METHOD AND APPARATUS FOR CHANGING A PILLOW OR PILLOWCASE

CROSS REFERENCE TO RELATED APPLICATION

This application claims priority under 35 U.S.C. §119(e) of U.S. provisional patent application Ser. No. 61/190,631 filed Sep. 2, 2008, which is incorporated by reference herein.

FIELD OF THE INVENTION

The present invention relates generally to methods and apparatus for changing a pillow arranged in the interior of a pillowcase or changing a pillowcase that covers a pillow. The present invention also relates to methods and apparatus for placing a pillow into the interior of a pillowcase, placing a pillowcase over a pillow, removing a pillow from the interior of a pillowcase and removing a pillowcase from around a pillow.

BACKGROUND OF THE INVENTION

There are prior art apparatus that facilitate the changing of a pillow or pillowcase, including U.S. Pat. Nos. 5,673,446 (Moen et al.), and 6,839,923 and 7,007,324 (Blessman), and U.S. Pat. Appln. Publ. No. 2009.0144901 (Zorger).

Moen et al. discloses a pair of flexible poles connected at one end by a resilient rubber strip. At the other end of the poles, a spring-loaded retaining ball captures the pillow between the two poles. A ball-shaped handle is connected to an internal cable and when the ball is pulled, it releases the spring-loaded retaining ball allowing the device to come out while the pillow stays in the pillowcase.

Blessman discloses a flexible thin sheet of material that is sized and configured so as to attain a generally U-shaped configuration for insertion into a pillowcase, thereby creating a three-dimensional cavity through which a pillow can be inserted. The device can then be easily extracted from the pillowcase by merely sliding it out once the pillow is in place.

Zorger discloses a flexible apparatus that lays flat in a neutral condition. After the pillow is placed onto the apparatus, the apparatus is wrapped around the pillow to compress the pillow, and edges of the apparatus are engaged with one another to maintain the pillow in a compressed condition. The apparatus and compressed pillow are slid into a pillowcase, or the pillowcase is slid over the apparatus and compressed pillow, and the apparatus is then slid outwardly from the pillowcase, allowing the pillow to expand and fill the pillowcase.

Other prior art discloses apparatus that hold an enclosure in an open condition to enable insertion of objects therein, but not pillows into pillowcases. For example, U.S. Pat. No. 6,065,512 (Munn, II) discloses a substantially rectangular panel that may be removably inserted into a nonrigid container, which container is comprised of at least one container wall defining a container opening. The panel is formed from a material such as polyvinyl chloride foam board or high impact polystyrene, and defines a centered aperture through each of its width-defining edge portions and a pair of spaced-apart apertures through each of its length-defining edge portions. The panel is alleged to be able to be repeatedly bent and inserted into a nonrigid container so that, upon release, the container may be retained in an upright and open position for easy access, all without breaking or cracking and without damaging the container either during retention of the container or during its removal therefrom.

U.S. Pat. No. 6,189,841 (LaPoint et al.) discloses an insert apparatus that is used to insert items into pouches and comprises a bending region designed to bend along a length of the apparatus; a non-bending region coupled to the bending region, having a gripping space positioned along a length thereof; a first and second insert foot located on either side of the gripping space; and a transition zone, located between the bending and non-bending regions, where the bend in the bending region gradually flattens out to the non-bending region.

U.S. Pat. No. 7,407,139 (Dolan) discloses a trash bag support apparatus that includes a flexible and unitary body selectively adaptable between linear and arcuate positions for removably inserting into a trash bag and engaging with an inner surface thereof. The body has opposed end portions and a top portion integral therewith. Elongated leg portions having lower edge portions are integrally disposed with the top portion and extend downwardly therefrom for defining a plurality of channels therebetween. The edge portions define a uniform line of weakness below which the trash bag is unsupported by the apparatus.

Some of these apparatus have a relatively complicated structure while others are not very easy to use. It is therefore desirable to provide an apparatus that is simple to construct and can be easily used to change a pillow or pillowcase.

OBJECTS AND SUMMARY OF THE INVENTION

It is an object of the present invention to provide new and improved methods and apparatus for changing a pillow arranged in the interior of a pillowcase or changing a pillowcase that covers a pillow.

It is also an object of the present invention to provide new and improved methods and apparatus for placing a pillow into the interior of a pillowcase, placing a pillowcase over a pillow, removing a pillow from the interior of a pillowcase and removing a pillowcase from around a pillow.

In order to achieve at least one of these objects and others, a first embodiment of a method for an individual to change a pillow in a pillowcase in accordance with the invention includes providing first and second members unattached to one another and each having opposed smooth surfaces, inserting the first and second members at least partially into the pillowcase containing a first pillow such that the first member is between a first side of the first pillow and an adjacent first side of the pillowcase and the second member is between a second side of the first pillow opposite the first side of the first pillow and an adjacent second side of the pillowcase, and then causing relative movement between the pillowcase and the first and second members with the first pillow therebetween until the first pillow is at least partially outside of the pillowcase. Thereafter, the first pillow is grasped and withdrawn from between the first and second members and then without fully removing the first and second members from the pillowcase, a new, second pillow is inserted between the first and second members. Then, the individual causes relative movement between the pillowcase and the first and second members with the second pillow therebetween until the second pillow is inside of the pillowcase; and withdraws the first and second members from the pillowcase, e.g., by turning the pillowcase to a position in which its opening faces downward and shaking the pillowcase to cause the first and second members to fall out of the pillowcase.

The first and second members are not attached to one another when used to change the pillow, and moreover, lack a mechanism to enable them to be attached to one another.

Preferably, to eliminate friction, the first and second members have smooth upper and lower major surfaces, i.e., those surfaces that will contact the outer surfaces of the pillow and inner surfaces of the pillowcase, and an opening at an upper end to thereby define a handle between the opening and the upper end. Also, the first and second members are thin and flexible to enable them to fit between the pillow and pillowcase and flex with the curvature of the pillow.

BRIEF DESCRIPTION OF THE DRAWING

The invention, together with further objects and advantages thereof, may best be understood by reference to the following description taken in conjunction with the accompanying drawings, wherein like reference numerals identify like elements and wherein.

DETAILED DESCRIPTION OF THE INVENTION

Figure 1:
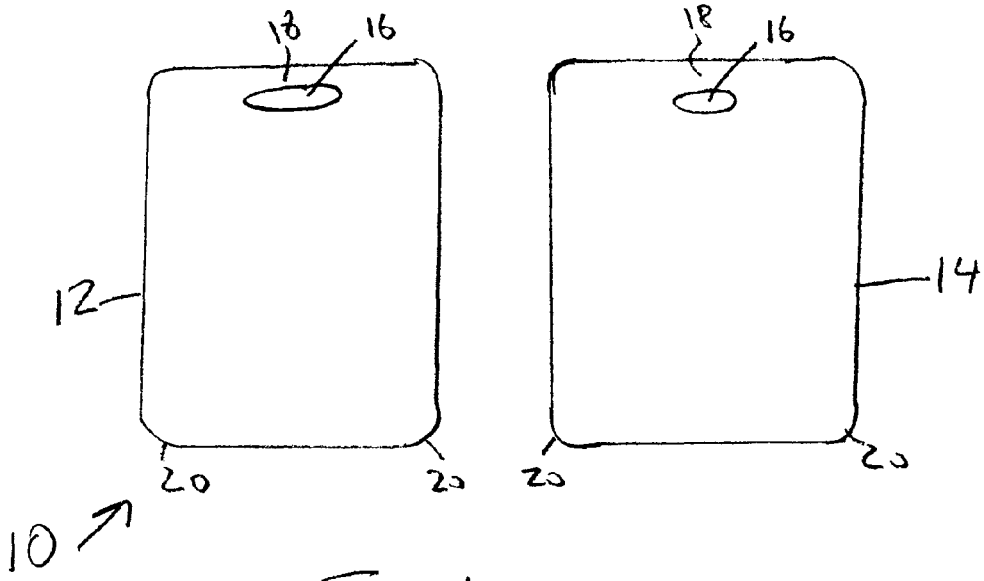
FIG. 1 is a front view of an apparatus for changing a pillow or pillowcase in accordance with the invention.

Referring to the accompanying drawings wherein like reference numerals refer to the same or similar elements, FIG. 1 shows an apparatus 10 that is used for changing a pillow or pillowcase in accordance with the invention. Changing of a pillow as used herein generally entails removing the pillow from the interior of the pillowcase, obtaining a new pillow and then inserting the new pillow into the same pillowcase. Changing of a pillowcase as used herein generally entails removing the pillowcase from around a pillow, obtaining a new pillowcase and then placing the new pillowcase around the same pillow.

The apparatus 10 includes a first member 12 and a second member 14 that is completely separate from and not attached to the first member 12. First and second members 12, 14 may have substantially the same form, or different forms. The nomenclature of the "first" and "second" members is used to describe the invention and is not intended to limit the invention to only two members. However, a preferred embodiment of the invention includes only the two members 12, 14.

Each member 12, 14 may be planar, with flat upper and lower surfaces or be provided with a slight curvature. A single pair of members 12, 14 may be constructed to enable use with various size pillows, e.g., standard, queen and king. Nevertheless, the members 12, 14 may have variable dimensions, one set of dimensions for each size pillow. One possible set of dimensions for the first and second members 12, 14 is a width of about 13 inches and a length of about 20 inches.

Each member 12, 14 is preferably provided with an opening 16 at one end to thereby define a handle 18 between the opening 16 and the adjacent edge of the member 12, 14 and enable easy handling and use, described below, and at least one rounded corner 20 at an end opposite the handle 18. Slots 16 may also be used to suspend the first and second members 12, 14 for storage.

The members 12, 14 may be made from polystyrene or a similar plastic material. The properties of the material, or at least the exposed outer major surfaces of the members 12, 14 should be extremely smooth, while the members 12, 14 themselves are thin, flexible and durable. The smooth outer major surfaces serves to minimize friction between the members 12, 14 and the outer surfaces of the pillow and inner surfaces of the pillowcase when changing a pillow or pillowcase, as well as eliminate friction between the pillow and the adjacent surfaces of the pillowcase when the first and second members 12, 14 are interposed therebetween.

Figure 2:
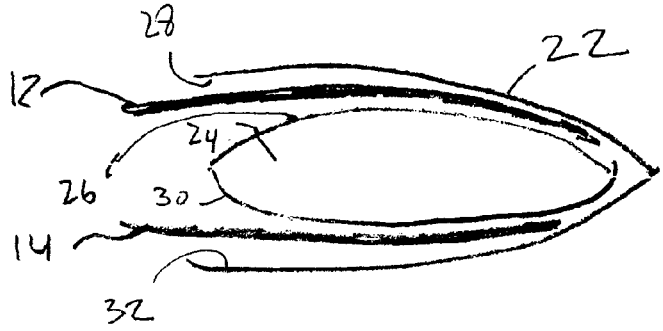
FIG. 2 is a cross-sectional view showing the apparatus in use in connection with a pillow and pillowcase during a process for changing the pillow or pillowcase.

With the apparatus 10, an exemplifying method for enabling an individual to change a pillow in a pillowcase using apparatus 10 in accordance with the invention includes inserting one member 12 at least partially into the pillowcase 22 containing the pillow 24 to a position between a first major side 26 of the pillow 24 and an adjacent side 28 of the pillowcase 22, and inserting the other member 14 at least partially into the pillowcase 22 to a position between a second, opposite major side 30 of the pillow 24 and an adjacent side 32 of the pillowcase 22 (see FIG. 2). Then, the individual causes relative movement between the pillowcase 22 and the members 12, 14 with the pillow 24 therebetween until the pillow 24 is at least partially outside of the pillowcase 22 and then grasps the pillow 24 and withdraws it from between the members 12, 14.

Thereafter, the individual inserts a new pillow between the members 12, 14, e.g., by pivoting the uppermost member upward and angling one or both corner on one side of the new pillow into the passage formed between the members. This step is preferably performed without fully removing the members 12, 14 from the pillowcase 22, i.e., the first and second members 12, 14 remain at least partially within the interior of the pillowcase 22.

Then, the individual causes relative movement between the pillowcase 22 and the members 12, 14 with the new pillow therebetween until the new pillow is inside of the pillowcase 22. The individual then withdraws the members 12, 14 from the pillowcase 22 which then contains the new pillow and is ready for use.

A related method for an individual to change a pillowcase 22 that surrounds a pillow 24 in accordance with the invention may include the steps of inserting the first member 12 at least partially, and possibly entirely, into the pillowcase 22 that contains pillow 24, and between a first side 26 of the pillow 24 and an adjacent first side 28 of the pillowcase 22, and also inserting the second member 14 at least partially, and possibly entirely, into the pillowcase 22 and between a second side 30 of the pillow 24 opposite the first side 26 of the pillow 24 and an adjacent second side 32 of the pillowcase 22 such that the pillow 24 is held between the first and second members 12, 14. The pillow 24 is thus sandwiched between the first and second members 12, 14 that are thus in contact with the pillowcase 22 and interposed between the sides 26, 30 of the pillow 24 and the sides 28, 32 of the pillowcase 22.

The first and second members 12, 14 are not attached to one another when they are inserted into the pillowcase 22. Thus, the invention differs from prior art constructions wherein multiple members are attached to one another when inserted into the pillowcase to hold it open for subsequent insertion of a pillow.

The extent to which the first and second members 12, 14 are inserted into the pillowcase 22 may depend on the ability of the individual changing the pillowcase 22, and while a complete insertion may be preferred for some individuals, a partial insertion may also enable practice of the invention and might be performed by individuals who develop expertise in using the invention.

Once the first and second members 12, 14 are in this position, they are held around the pillow 24 and then the individual causes relative movement of the pillowcase 22 and the first and second members 12, 14 until the pillowcase 22 is removed from contact with the first and second members 12, 14. This relative movement may be moving the pillowcase 22 while holding the first and second members 12, 14 substantially stationary and around the pillow 24, moving the first and second members 12, 14 and the pillow 24 therebetween while holding the pillowcase 22 substantially stationary, moving the pillowcase 22 in one direction and the first and second members in an opposite direction, or a combination thereof. The individual may hold the first and second members 12, 14 and pillow 24 therebetween against their body or against a horizontal surface and pull the pillowcase 22 away from the first and second members 12, 14.

A new pillowcase is then obtained and readied for placement over the pillow 24. At this stage, while maintaining the pillow 24 between the first and second members 12, 14, and preferably continuously from the time of the removal of the "old" pillowcase 22 from contact with the first and second members 12, 14, the individual causes relative movement of the new pillowcase and the first and second members 12, 14 until the new pillowcase is at least partially and possibly entirely, over the pillow 24. This relative movement may be moving the new pillowcase 18 while holding the first and second members 12, 14 substantially stationary and around the pillow 24, moving the first and second members 12, 14 and the pillow 24 therebetween while holding the new pillowcase 18 substantially stationary, moving the new pillowcase in one direction and moving the first and second members 12, 14 in an opposite direction, or a combination thereof. The individual may hold the first and second members 12, 14 and pillow 24 therebetween against their body or against a horizontal surface and pull the new pillowcase 22 around the first and second members 12, 14.

Once the new pillowcase is partially or possibly entirely around the pillow 24, the individual removes the first and second members 12, 14 from contact with the new pillowcase with the result that the new pillowcase is now either entirely around the pillow 24 or can be easily manipulated to be entirely or only partially around the pillow 24 as desired.

The foregoing methods for changing a pillowcase or pillow are exemplary only, providing basic methods for using the apparatus 10, and other methods for using the apparatus are also envisioned. For example, the apparatus 10 may be used for only removing a pillow from a pillowcase or removing a pillowcase from around a pillow. In these cases, the method includes only the initial steps described above until the pillowcase 22 is pulled away from the first and second members 12, 14. The first and second members 12, 14 can then be removed from contact with the pillow 24 and the pillow 24 placed at a desired location.

An alternative method for removing a pillow from a pillowcase or a pillowcase from around a pillow is to insert the first and second members 12, 14 between the opposite sides of the pillow and the adjacent sides of the pillowcase and then turn the pillow such that the opening of the pillowcase faces downward. The pillowcase is then grasped and shaken causing the first and second members 12, 14 and pillow 24 therebetween, to drop from the pillowcase 22. If this method is performed over a horizontal surface, then the first and second members 12, 14 and pillow 24 will fall onto this surface.

Similarly, the apparatus 10 may be used for only placing a pillowcase around a pillow or a pillow into a pillowcase. In these cases, the method includes generally the latter steps described above, i.e., starting from the step in which the pillow 24 is held between the first and second members 12, 14 and a new pillowcase is obtained.

Another method for placing a pillow into a pillowcase, or placing a pillowcase around a pillow, using apparatus 10 entails placing the first and second members 12, 14 at least partially into the interior of the pillowcase, that may be in an extended or compacted form (e.g., folded in half), without the pillow therebetween. For a partial insertion, the first and second members 12, 14 may be inserted anywhere from about 4 inches to about 6 inches into the pillowcase. The pillowcase may be on a horizontal surface. The first and second members 12, 14 may be inserted simultaneously and/or alongside one another.

The uppermost member 12 or 14 is then lifted up relative to the lowermost member, or pivoted upward, to form a narrowing passage leading into the closed end of the pillowcase. A pillow is then inserted into this passage, preferably by initially placing a corner of the pillow into the passage and then pivoting the pillow during the continued forward progress of the pillow into the passage. The uppermost member may then be extended over the pillow, and areas around or including the side seams of the pillowcase are grasped and pulled toward the individual to cause the pillowcase to slide over the first and second members and thus over the pillow. This latter stage may be performed by lifting the pillowcase and shaking the pillowcase. The first and second members are then removed from their position interposed between the pillow and the pillowcase.

Advantages of this method include the ease with which a pillow can be inserted into a pillowcase, or a pillowcase placed around a pillow, and the avoidance of a need to straighten the pillowcase after placement around the pillow. Appropriate dimensioning of the first and second members, i.e., to have a width close to but slightly less than the width of the pillowcase edge, avoids the need to straighten the pillowcase.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method for changing a pillow in a pillowcase, comprising:

providing first and second members unattached to one another and each having opposed smooth surfaces;

inserting the first member, while unattached to the second member, at least partially into the pillowcase containing a first pillow such that the first member is between a first side of the first pillow and an adjacent first side of the pillowcase;

inserting the second member, while unattached to the first member, at least partially into the pillowcase such that the second member is between a second side of the first pillow opposite the first side of the first pillow and an adjacent second side of the pillowcase;

after the first and second members have both been inserted at least partially into the pillowcase and are not attached to one another, causing relative movement between the pillowcase and the first member and causing relative movement between the pillowcase and the second member, independent of the relative movement between the pillowcase and the first member, with the first pillow between the first and second members until the first pillow is at least partially outside of the pillowcase; then grasping the first pillow and withdrawing the first pillow from between the first and second members while maintaining the first and second members unattached to one another without a pillow therebetween; then without fully removing the first and second members from the pillowcase, moving an outward end region of the first member away from an outward end region of the second member to form a passage between the outward end regions of first and second members;

inserting a second pillow into the passage between the outward end regions of the first and second members while the first and second members are not attached to one another; then causing relative movement between the pillowcase and the first and second members with the second pillow therebetween until the second pillow is inside of the pillowcase; and then withdrawing the first and second members from the pillowcase independently of one another.

2. The method of claim 1, wherein the step of withdrawing the first and second members from the pillowcase comprises turning the pillowcase to a position in which its opening faces downward and then shaking the pillowcase to cause the first and second members to separately fall out of the pillowcase.

3. The method of claim 1, wherein the step of causing relative movement between the pillowcase and the first and second members with the first pillow therebetween until the first pillow is at least partially outside of the pillowcase comprises at least one of:

moving the pillowcase while holding the first and second members substantially stationary and not attached to one another;

moving the first and second members and the first pillow therebetween while holding the pillowcase substantially stationary; and moving the first and second members and the first pillow therebetween in one direction and the pillowcase in an opposite direction.

4. The method of claim 1, wherein the step of causing relative movement between the pillowcase and the first and second members with the second pillow therebetween until the second pillow is inside of the pillowcase comprises at least one of:

moving the pillowcase while holding the first and second members substantially stationary and not attached to one another;

moving the first and second members and the second pillow therebetween while holding the new pillowcase substantially stationary; and moving the first and second members and the second pillow therebetween in one direction and the pillowcase in an opposite direction.

5. A method for changing a pillowcase that at least partially surrounds a pillow, comprising:

inserting a first member at least partially into the pillowcase and between a first side of the pillow and an adjacent first side of the pillowcase;

inserting a second member, while unattached to the first member, at least partially into the pillowcase and between a second side of the pillow opposite the first side of the pillow and an adjacent second side of the pillowcase such that the pillow is sandwiched between the first and second members; then while holding the first and second members, unattached to one another, and thus the pillow sandwiched therebetween, causing relative movement of the pillowcase and the first member and causing relative movement of the pillowcase and the second member independent of the relative movement of the pillowcase and the first member until the pillowcase is removed from contact with the first and second members; then maintaining the pillow between the first and second members, unattached to one another, after removal of the pillowcase from contact with the first and second members and before placement of a new pillowcase around the pillow;

causing relative movement of the new pillowcase and the first member and causing relative movement of the new pillowcase and the second member independent of the relative movement of the new pillowcase and the first member until the new pillowcase is at least partially over the first and second members being maintained around the pillow; and then removing the first and second members from contact with the new pillowcase independently of one another.

6. The method of claim 5, wherein the step steps of causing relative movement of the new pillowcase and the first and second members until the new pillowcase is at least partially over the pillow comprises causing relative movement of the new pillowcase and the first and second members until the new pillowcase is entirely over the pillow.

7. The method of claim 5, further comprising constructing the first and second members without any mechanism that enables the first and second members to be attached to one another.

8. The method of claim 5, wherein the step of causing relative movement of the pillowcase and the first and second members until the pillowcase is removed from contact with the first and second members comprises at least one of:

moving the pillowcase while holding the first and second members substantially stationary and not attached to one another;

moving the first and second members and the pillow therebetween while holding the pillowcase substantially stationary; and moving the first and second members and the pillow therebetween in one direction and the pillowcase in an opposite direction.

9. The method of claim 5, wherein the step of causing relative movement of the new pillowcase and the first and second members until the new pillowcase is at least partially over the pillow comprises at least one of moving the new pillowcase while holding the first and second members substantially stationary and not attached to one another;

moving the first and second members and the pillow therebetween while holding the new pillowcase substantially stationary; and moving the first and second members and the pillow therebetween in one direction and the pillowcase in an opposite direction.

* * * * *